US007532950B2

(12) United States Patent
Cha et al.

(10) Patent No.: US 7,532,950 B2
(45) Date of Patent: May 12, 2009

(54) INTEGRATED MANAGEMENT SYSTEM AND METHOD FOR CONTROLLING MULTI-TYPE AIR CONDITIONERS

(75) Inventors: Byoung-Keun Cha, Seoul (KR); Sang-Chul Youn, Seoul (KR); Duck-Gu Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/945,287

(22) Filed: Nov. 27, 2007

(65) Prior Publication Data

US 2008/0188989 A1 Aug. 7, 2008

(30) Foreign Application Priority Data

Feb. 1, 2007 (KR) ..... 10-2007-0010790

(51) Int. Cl.
*G05D 23/00* (2006.01)
*G06F 15/16* (2006.01)

(52) U.S. Cl. ..... 700/277; 709/230; 62/175

(58) Field of Classification Search ..... 700/277, 700/278; 62/149, 151, 157, 175, 224, 277, 62/527; 236/51; 709/230
See application file for complete search history.

(56) References Cited

U.S. PATENT DOCUMENTS

| | | | | |
|---|---|---|---|---|
| 5,435,147 | A | 7/1995 | Mochizuki et al. | |
| 7,340,909 | B2 * | 3/2008 | Kwon et al. | 62/175 |
| 2002/0104323 | A1 | 8/2002 | Rash et al. | |
| 2004/0204793 | A1 * | 10/2004 | Yoon et al. | 700/277 |
| 2005/0155368 | A1 | 7/2005 | Oh et al. | |
| 2005/0209739 | A1 * | 9/2005 | Kwon et al. | 700/277 |
| 2006/0162353 | A1 | 7/2006 | Ha et al. | |
| 2006/0212175 | A1 * | 9/2006 | Kim et al. | 700/277 |
| 2007/0095084 | A1 | 5/2007 | Park et al. | |
| 2007/0113568 | A1 | 5/2007 | Jang et al. | |
| 2007/0130967 | A1 | 6/2007 | Park et al. | |
| 2007/0157644 | A1 | 7/2007 | Kim et al. | |

FOREIGN PATENT DOCUMENTS

| | | |
|---|---|---|
| EP | 1429083 | 6/2004 |
| EP | 1703684 | 9/2006 |
| EP | 1719957 | 11/2006 |
| EP | 1804007 | 7/2007 |
| JP | 2006-052928 | 2/2006 |
| JP | 2006-337021 | 12/2006 |

OTHER PUBLICATIONS

English language Abstract of JP 2006-337021.
English language Abstract of JP 2006-052928.

* cited by examiner

*Primary Examiner*—Albert DeCady
*Assistant Examiner*—Douglas S Lee
(74) *Attorney, Agent, or Firm*—Greenblum & Bernstein, P.L.C.

(57) ABSTRACT

An integrated management system for controlling multi-type air conditioners can effectively enable to perform maintenance, management and after-service to at least one air conditioner systems by adding provision for product information into a communication protocol such that operation information and product information related to multi-type air conditioners from the at least one air conditioner system can be received, stored and used.

7 Claims, 2 Drawing Sheets

INTEGRATED MANAGEMENT SYSTEM AND METHOD FOR CONTROLLING MULTI-TYPE AIR CONDITIONERS

BACKGROUND OF THE INVENTION

1. Field of the Invention

The present invention relates to an integrated management system and method for controlling multi-type air conditioners, and more particularly, to an integrated management system and method for controlling multi-type air conditioners which can integrally be controlled by adding product information to a body portion of a communication protocol.

2. Description of the Background Art

With the recent increase in the use of air conditioner systems, air conditioner systems are now used in most buildings and homes. As one type of air conditioner system, so-called "multi-type" air conditioners include indoor units disposed in each room of a home or in each office in an office building, and an outdoor unit shared by and connected to the plural indoor units.

Hereinafter, a system comprised of a plurality of multi-type air conditioner is referred to as a multi-type air conditioner system.

The plurality of air conditioner systems includes a local controller which detects operation states of the plurality of air conditioners and, according to the detection, controls the plurality of air conditioners via a gateway.

Recently, an integrated management system for controlling the multi-type air conditioners is being developed to integrally manage at least one air conditioner system at a long distance.

When operating such integrated management system for controlling the multi-type air conditioners, to integrally control the plurality of air conditioner systems, information related to the multi-type air conditioners, which are disposed in a particular area (e.g., a room or office) and are being operated, is collected.

The collected operation information (cycle data) is written (composed and formatted) according to a specific communication protocol, and includes operation information related to only an air conditioner which is being operated. A service manager may check operation information related to a corresponding air conditioner through a monitoring service, and remotely control at least one air conditioner system.

However, when the at least one air conditioner system is remotely controlled, the service manager cannot know product information (e.g., product model name, type, capacity, etc.) related to all operating air conditioners, thereby making it difficult to maintain, manage and provide after-service.

That is, in order to maintain, manage and provide after-service to at least one air conditioner system, there is a need to know which products are disposed in a particular area.

However, since a related art communication protocol does not include provision for product information, the service manager cannot properly deal with problems which may arise.

SUMMARY OF THE INVENTION

Therefore, in order to solve those problems of the related art, it is an object of the present invention to provide an integrated management system and method for controlling multi-type air conditioners which can effectively enable to perform maintenance, management and after-service to at least one air conditioner system, by adding provision for product information into a communication protocol such that operation information and product information related to multi-type air conditioners from the at least one air conditioner system are received, stored and used.

To achieve these and other advantages and in accordance with the purpose of the present invention, as embodied and broadly described herein, there is provided an integrated management system for controlling multi-type air conditioners according to one embodiment of the present invention, comprising: one or more air conditioner systems each having one or more air conditioner groups provided with a local controller connected to multi-type air conditioners via a gateway, and configured to convert a first information data related to the one or more air conditioner groups according to a remote communication protocol for transmission; and a remote integrated management system configured to receive the first information data according to the remote communication protocol from the one or more air conditioner systems, and remotely control the one or more air conditioner systems based on the first information data.

Here, the remote integrated management system includes an application server which analyzes data received from the plurality of air conditioner systems and writes operation control information based on the analysis result according to the remote communication protocol for transmission; and a database server which stores product information analyzed by the application server.

To achieve these and other advantages and in accordance with the purpose of the present invention, as embodied and broadly described herein, there is provided an integrated management method for controlling multi-type air conditioners according to one embodiment of the present invention, comprising: a first step of converting a first information data related to one or more air conditioner groups according to a remote communication protocol for transmission; a second step of receiving the first information data converted according to the remote communication protocol for analysis, and writing operation control information based on the analysis result according to the remote communication protocol for transmission; and a third step of analyzing the operation control data received according to the remote communication protocol and operating based on the analysis result.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Description will now be given in detail to the preferred embodiments of the present invention, examples of which are illustrated in the accompanying drawings.

Figure 1:
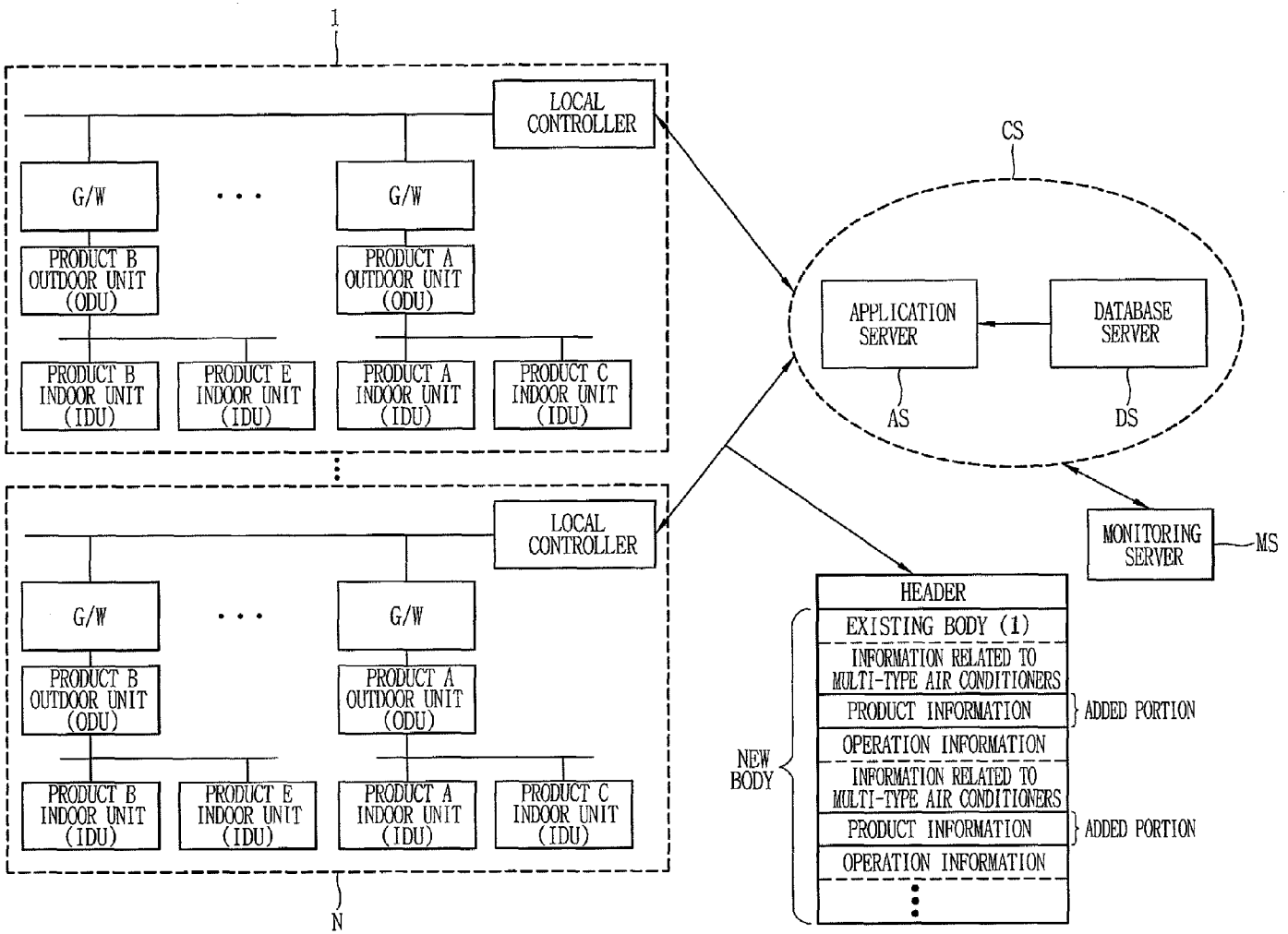
FIG. 1 is a schematic view illustrating an integrated management system for controlling multi-type air conditioners according to one embodiment of the present invention.

FIG. 1 is a schematic view illustrating an integrated management system for controlling multi-type air conditioners according to one embodiment of the present invention.

As shown in FIG. 1, there are provided a plurality of air conditioner systems 1 to N, a remote integrated management system CS, and a monitoring server MS.

The plurality of air conditioner systems 1 to N each includes one or more air conditioner groups having a local controller connected to multi-type air conditioners via a gateway GW, converts operation information or product information related to the one or more of the air conditioner groups according to a remote communication protocol, and then transmits the converted data in a wireless or wired manner.

Here, the term "plurality of air conditioner groups" denotes installed air conditioning facilities including multi-type air conditioners capable of satisfying heating/cooling requirements of a corresponding building by connecting at least one indoor unit to one outdoor unit. The plurality of air conditioner groups allow not only to separately control each of the air conditioners using an indoor unit disposed in each room or space but also to integrally control every air conditioner in a building from a certain location by means of a local controller.

The remote integrated management system CS receives the data converted according to the remote communication protocol from the one or more air conditioner systems 1 to N, and remotely controls the one or more air conditioner systems 1 to N based on the received data.

The remote integrated management system CS is provided with an application server AS which analyzes data received from the plurality of air conditioner systems 1 to N, and writes operation control information based on the analysis result according to the remote communication protocol for transmission, and a database server DS which stores product information analyzed by the application server AS.

Here, the data received from the one or more air conditioner systems 1 to N includes a header portion containing data such as information related to the plurality of air conditioner systems 1 to N, version information, etc., and a body portion containing data such as an outdoor unit ID, a group number, operation state, operation mode, product information, and the like.

That is, the data utilized in accordance with the present invention includes product information related to a corresponding air conditioner group.

The monitoring server MS displays product information and operation information related to the plurality of the air conditioner systems 1 to N that a service manager desires to know.

Here, the monitoring server MS may be set to automatically display operation information related to the plurality of air conditioner systems 1 to N that the service manager wants to know.

Figure 2:
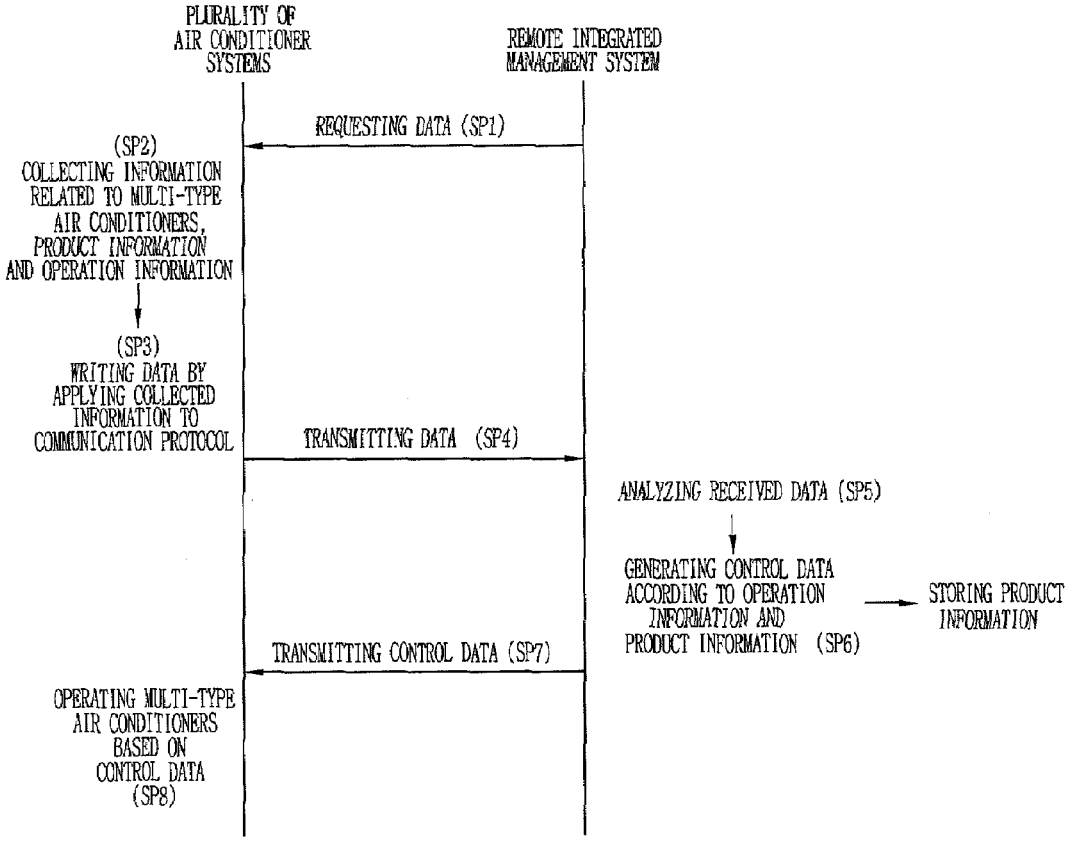
FIG. 2 is a flowchart illustrating an operation of an integrated management method for controlling multi-type air conditioners according to the present invention.

With such a configuration, the operation of the remote integrated management system for controlling the multi-type air conditioners according to the present invention will now be described with reference to FIG. 2.

First, according to the present invention, a communication protocol is changed such that product information can be added into the data exchanged between the remote integrated management system and the plurality of air conditioner systems.

Here, according to the present invention, the data to which the product information is added may be used by adding a simple operation to an existing network environment.

In such state, the remote integrated management system CS requests data from at least one air conditioner system 1 to N (SP1).

Then, the at least one air conditioner system 1 to N collects operation information and product information related to the plurality of air conditioner groups which are being operated (SP2), and writes data, in which product information is included, by applying the collected data to a communication protocol according to the present invention (SP3).

Next, the at least one air conditioner system 1 to N transmits the data so written according to the communication protocol to the remote integrated management system CS (SP4). The remote integrated management system CS analyzes the data received from the at least one air conditioner system 1 to N (SP5), and generates control data based on analyzed operation information and product information therein according to the analysis result (SP6).

Here, the remote integrated management system CS may automatically generate control data according to the analyzed operation information and product information, or may manually generate control data by command of the service manager who has recognized the operation information and product information.

In other words, the application server AS of the remote integrated management system CS analyzes data received from the plurality of air conditioner systems 1 to N, and writes operation control information based on the analysis result according to the remote communication protocol for transmission. The database server DS of the remote integrated management system stores the product information analyzed by the application server AS.

In addition, the monitoring server MS of the remote integrated management system CS is set to manually or automatically display the product information and operation information related to the plurality of air conditioner systems 1 to N that the service manager desires to know.

Thereafter, the remote integrated management system CS transmits control data based on the analyzed operation information and product information to the at least one air conditioner system 1 to N, and therefore, the one or more air conditioner systems 1 to N operate multi-type air conditioners connected thereto based on the control data.

That is, in accordance with the present invention, a communication protocol is changed such that product information can be added into transmission data exchanged between the plurality of air conditioner systems and the remote integrated management system.

The above-described integrated management system for controlling multi-type air conditioners according to the present invention can be applied to a system comprised of multi-type air conditioners and a single-type air conditioner, as well as to a system comprised of only multi-type air conditioners.

The preferred embodiments of the present invention have been described in detail with reference to the drawings; however, they should not be construed as limiting the scope of the present invention. Also, it will be obvious to those skilled in the art that variations may be implemented within the scope as defined by the appended claims.

As described above, the integrated management system for controlling multi-type air conditioners according to the present invention can effectively perform maintenance, management and after-service on at least one air conditioner system by adding product information to a communication protocol such that operation information and product information related to multi-type air conditioners from the at least one air conditioner system are received, stored and used.

The foregoing embodiments and advantages are merely exemplary and are not to be construed as limiting the present disclosure. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An integrated management system for controlling multi-type air conditioners, comprising:

one or more air conditioner groups provided with multi-type air conditioners, at least one gateway, and a local controller connected to the multi-type air conditioners via the gateway, the multi-type air conditioners including at least one outdoor unit and a plurality of indoor units each connected to the outdoor unit;

one or more air conditioner systems each having the air conditioner groups, and configured to convert information data related to the air conditioner groups according to a remote communication protocol for transmission; and a remote integrated management system configured to receive the information data according to the remote communication protocol from the air conditioner systems, and remotely control the air conditioner systems based on the information data, wherein the information data comprises one or more of operation information or product information of the outdoor units, the indoor units, the gateways, and the local controllers included in the air conditioner groups.

2. The integrated management system of claim 1, wherein the received data includes a header portion containing at least one of information related to the plurality of air conditioner systems and version information, and a body portion containing at least one of an outdoor unit ID, a group number, operation state, operation mode and product information.

3. The integrated management system of claim 1, wherein the remote integrated management system comprises:

an application server which analyzes data received from the plurality of air conditioner systems and writes operation control information based on the analysis result according to the remote communication protocol for transmission; and a database server which stores product information analyzed by the application server.

4. The integrated management system of claim 3, wherein the remote integrated management system further comprises a monitoring server which displays product information and operation information related to the plurality of air conditioner systems.

5. An integrated management method for controlling multi-type air conditioners, comprising:

converting information data related to one or more air conditioner groups according to a remote communication protocol for transmission, and transmitting the converted information data;

receiving the information data converted according to the remote communication protocol for analysis, analyzing the received information data, and transmitting operation control information based on the analysis result; and analyzing the operation control information received according to the remote communication protocol and operating the one or more air conditioner groups based on the analysis result, wherein the information data comprises one or more of operation information or product information of outdoor units, indoor units, gateways and local controllers included in the air conditioner groups.

6. The integrated management method of claim 5, further comprising storing the analyzed operation control information.

7. The integrated management method of claim 5, further comprising: displaying product information and operation information related to a plurality of air conditioner systems.

* * * * *